US006591524B1

(12) United States Patent
Lewis et al.

(10) Patent No.: US 6,591,524 B1
(45) Date of Patent: Jul. 15, 2003

(54) ADVERTISING ARTICLE WITH AUTOMATICALLY ACTIVATED FLASHER OR SOUND MODULE

(75) Inventors: Edward D. Lewis, Danville, IN (US); Timothy D. Hogue, Indianapolis, IN (US)

(73) Assignee: Buztronics, Inc., Indianapolis, IN (US)

( * ) Notice: Subject to any disclaimer, the term of this patent is extended or adjusted under 35 U.S.C. 154(b) by 0 days.

(21) Appl. No.: 08/730,597

(22) Filed: Oct. 15, 1996

(51) Int. Cl.[7] ..... G09F 3/00
(52) U.S. Cl. ..... 40/324; 310/339
(58) Field of Search ..... 40/324; 310/319, 310/339

(56) References Cited

U.S. PATENT DOCUMENTS

| | | | | |
|---|---|---|---|---|
| 2,224,319 A | | 12/1940 | Schroyer | |
| 2,604,579 A | | 7/1952 | Deneboudes | |
| 2,663,866 A | | 12/1953 | Simpson | |
| 3,509,388 A | | 4/1970 | Mifune et al. | 310/339 |
| 3,729,639 A | | 4/1973 | Heinouchi et al. | 405/135 |
| 3,735,113 A | | 5/1973 | Stott | |
| 3,898,534 A | | 8/1975 | Mohr | 310/339 |
| 4,055,014 A | | 10/1977 | Schmidt et al. | |
| 4,151,923 A | | 5/1979 | Bernardi | |
| 4,169,970 A | | 10/1979 | Opiela et al. | |
| 4,176,340 A | | 11/1979 | Steinmeier | |
| 4,299,041 A | | 11/1981 | Wilson | |
| 4,358,754 A | | 11/1982 | Young et al. | |
| 4,366,768 A | * | 1/1983 | Kulischenko et al. | 310/318 |
| 4,390,928 A | | 6/1983 | Runge | |
| 4,595,352 A | | 6/1986 | Endelson | 431/254 |
| 4,608,508 A | | 8/1986 | Ohnishi | 310/339 |
| 4,789,073 A | | 12/1988 | Fine | |
| 4,922,355 A | | 5/1990 | Dietz et al. | |
| 4,934,079 A | | 6/1990 | Hoshi | |
| 4,951,045 A | | 8/1990 | Knapp et al. | |
| 5,065,067 A | | 11/1991 | Todd et al. | |
| 5,070,435 A | | 12/1991 | Weller | |
| 5,119,279 A | | 6/1992 | Makowsky | |
| 5,143,439 A | | 9/1992 | Lewis et al. | |
| 5,211,699 A | | 5/1993 | Tipton | |
| 5,266,920 A | | 11/1993 | Langner | |
| 5,275,277 A | | 1/1994 | Gallegos | |
| 5,275,285 A | | 1/1994 | Clegg | |
| 5,309,141 A | | 5/1994 | Mason et al. | |
| 5,333,101 A | | 7/1994 | McEvoy | |
| 5,339,548 A | | 8/1994 | Russell | |
| 5,373,426 A | | 12/1994 | O'Sullivan | |
| 5,495,136 A | * | 2/1996 | Chiang et al. | 310/339 |
| 5,500,635 A | * | 3/1996 | Mott | 310/319 |
| 5,524,817 A | | 6/1996 | Meier et al. | |
| 5,553,735 A | | 9/1996 | Kimura | |
| 6,065,688 A | * | 5/2000 | Wilson | 239/99 |

OTHER PUBLICATIONS

Data sheet for MS06 Flash Driver, date unknown.

* cited by examiner

*Primary Examiner*—Cassandra H. Davis
(74) *Attorney, Agent, or Firm*—William F. Bahret

(57) ABSTRACT

An advertising article with an automatically activated indicator assembly attached to the article including a piezoelectric sensor, a printed circuit board including a triggerable signal generator, and an LED or speaker. The piezoelectric sensor is attached to the advertising article such that it is responsive to mechanical force experienced by the advertising article during normal use, and, in response to such force, produces an output level sufficient to trigger the signal generator which in turn supplies a signal to activate the LED or speaker which is connected thereto. The signal generator includes device control circuitry for providing a battery-saving sleep state.

11 Claims, 6 Drawing Sheets

ADVERTISING ARTICLE WITH AUTOMATICALLY ACTIVATED FLASHER OR SOUND MODULE

BACKGROUND OF THE INVENTION

This invention relates to advertising articles, and particularly to such articles having an automatically activated indicator such as a light source or sound source.

Various methods of drawing attention to or otherwise enhancing the effect of an advertising message or symbol on a physical article have been proposed in the past, such as a method, disclosed in U.S. Pat. No. 4,358,754 to Young et al., of illuminating an advertising symbol in a flashing manner in synchronization with variations in the volume of a detected sound.

U.S. Pat. No. 4,934,079 to Hoshi discloses a display panel device having a sensor sensitive to heat, light, sound waves, currents and magnetism, and a recorder/playback mechanism which is automatically activated by the sensor to play back a recorded message such as an advertising message in audible form. A device in the form of a greeting card, display card or the like, which is said to be useful for advertising-promotional display literature, is disclosed in U.S. Pat. No. 4,299,041 to Wilson. The disclosed device includes an effects generator which produces light and/or sound and/or movement of parts in response to light, sound, temperature, internal timers, attitude or position of the device or touch, such as an electrical conductive path being produced between two contacts, or standard radio frequencies, electromagnetic radiation or humidity change.

Illuminated drinking glasses bearing advertising indicia and having automatically activated indicators have also been proposed, such as in U.S. Pat. No. 5,211,699 to Tipton, which patent discloses a mercury tilt switch to complete a lighting circuit when the glass is upright, and U.S. Pat. No. 2,663,866 to Simpson, which patent discloses a conductive ball that moves when the glass is tilted more than 90° from its upright position, and thereby completes a circuit which turns on a light.

Illuminated drinking vessels have been an object of interest for more than fifty years, as exemplified by the above-referenced Simpson patent and the following patents:

| Patent No. | Inventor | Issue Date |
|---|---|---|
| 2,224,319 | Schroyer | Dec. 10, 1940 |
| 4,390,928 | Runge | Jun. 28, 1983 |
| 4,922,355 | Dietz et al. | May 1, 1990 |
| 5,119,279 | Makowsky | Jun. 2, 1992 |
| 5,339,548 | Russell | Aug. 23, 1994 |

Illumination is controlled in a number of different ways in the devices disclosed in these patents, such as a plunger-activated switch in the Schroyer patent, tilt switches with conductive balls or mercury beads, as in the Runge and Russell patents, a simple mechanical switch in the Makowsky patent, and an impedence-based moisture sensor in the Dietz et al. patent. Russell also discloses a liquid level detector which employs a piezoelectric sound transceiver having two piezo films physically apart from one another, embedded in the side/base corner of the cup, with the two piezo films designed to operate in concert by responding to periodic signals from a noise/frequency generator with periodic return signals at particular frequencies and power levels dependent on the level of liquid in the cup. The design is said to be based on the fundamental principle that the harmonic frequency of the cup and liquid changes as the amount of liquid in the cup changes. Russell also mentions that other types of transceivers and transducers may be used to detect level changes, such as pressure, optical, fluid, mechanical, or surface acoustic waves.

All known prior art advertising articles with controlled light or sound sources, such as those described above, have disadvantages such as mechanical, electrical or electronic complexity, or an inability to produce desired effects during normal use of the article, e.g., a drinking cup. For example, it would be particularly attention-getting to have lights begin to flash on a cup when it is set or tapped on a table or when the side of the cup is rapped with one's fingernails or knuckles, and then to sustain the flashing action when the cup is simply held in one's hand or allowed to rest on the table. Various devices are known for initiating a response when a drinking vessel is picked up or tilted a required amount or when the liquid level changes, as discussed above, but numerous efforts over manysyears involving lighted drinking vessels have failed to produce a simple, inexpensive device capable of producing a simple, desirable response such as that described above.

Moreover, there remains a need for advertising articles with automatically activated indicators in which the sensor occupies minimal space and in which the sensor and complete indicator assembly have minimal impact on the design of the overall article.

A further need exists for advertising articles with automatically activated indicators in which the sensor, indicator and entire article are of simple construction, compact, inexpensive to manufacture, and efficient and reliable in operation.

SUMMARY OF THE INVENTION

This invention overcomes the above-stated disadvantages and other drawbacks of the prior art and meets the above-stated needs as well as others.

The invention employs a piezoelectric sensor attached to an advertising article such that the sensor is responsive to mechanical force experienced by the advertising article during normal use, and, in response to such force, produces an output level sufficient to trigger a signal generator which in turn supplies a signal to activate a visual or audible indicator which is connected thereto.

One embodiment of the invention is a drinking vessel with an automatically activated indicator, in which the drinking vessel has a piezoelectric sensor mounted therein which is responsive to mechanical force experienced by the drinking vessel. A triggerable signal generator has a trigger input connected to the piezoelectric sensor and is triggered by a predetermined output signal level produced by the piezoelectric sensor in response to force experienced by the drinking vessel during normal use. A visual or audible indicator is connected to and activated by the signal generator.

A drinking vessel with an automatically activated visual indicator according to this invention has no moving parts such as conductive balls therein and therefore has increased reliability, and also sounds and feels no different to the user than an ordinary drinking vessel. There is no adverse effect on the user's comfort level in drinking out of the vessel, as there might be if the user heard or felt something move in the vessel as he started to drink out of it.

In another embodiment of the invention, a tabletop advertising article comprises a panel bearing advertising indicia, means for supporting the advertising panel in an upright position on a tabletop, a piezoelectric sensor mounted on the advertising panel and responsive to mechanical force experienced by the panel, a triggerable signal generator having a trigger input connected to the piezoelectric sensor and triggered by a predetermined output signal level produced by the piezoelectric sensor in response to force experienced by the advertising panel during normal use, and an indicator connected to the signal generator.

Another embodiment of the invention is an advertising ornament having a panel bearing advertising indicia, means for hanging the advertising panel on a movable vertical support surface so as to allow the panel to swing with respect to the support surface, a piezoelectric sensor mounted on the advertising panel and responsive to mechanical force experienced by the vertical support surface, a triggerable signal generator having a trigger input connected to the piezoelectric sensor and triggered by a predetermined output signal level produced by the piezoelectric sensor in response to force experienced by the vertical support surface during normal use, and an indicator connected to the signal generator.

It is a general object of the invention to provide an improved advertising article and method of attracting attention to advertising articles.

Another object of the invention is to provide a simple, inexpensive device capable of reliably producing desirable responses.

A further object of the invention is to provide an advertising article with automatically activated indicator in which the sensor occupies minimal space and in which the sensor and complete indicator assembly have minimal impact on the design of the overall article.

Yet another object is to provide an improved advertising article with automatically activated indicator in which the sensor, indicator and entire article are of simple construction, compact, inexpensive to manufacture, and efficient and reliable in operation.

A still further object of the invention is to increase the reliability of an automatically activated indicator by eliminating moving parts.

These and other objects and advantages of the present invention will become more apparent upon reading the following detailed description in conjunction with the accompanying drawings.

DETAILED DESCRIPTION OF THE PREFERRED EMBODIMENT

Figure 1:
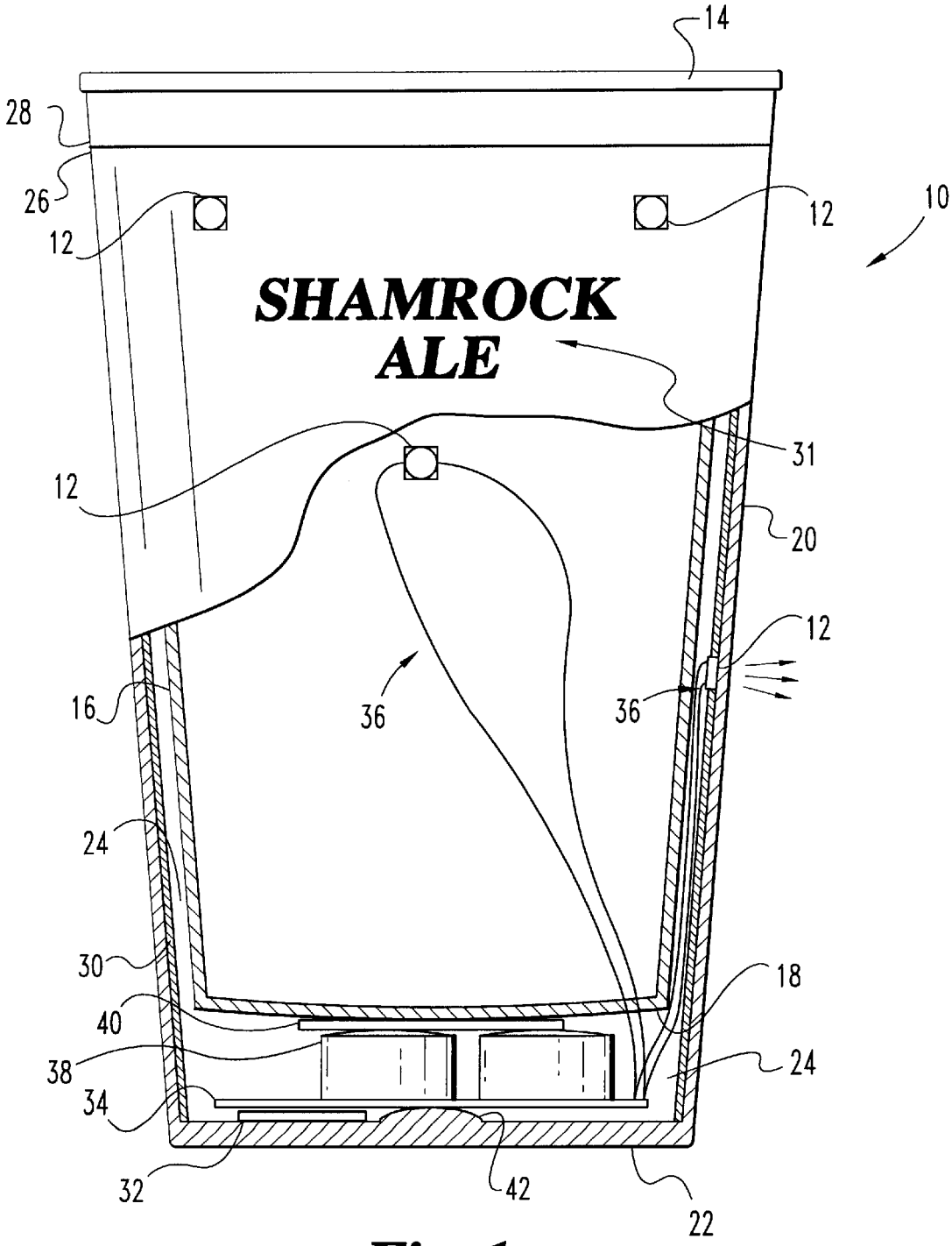
FIG. 1 is a drawing of the preferred embodiment of a drinking vessel with force-activated indicator according to the present invention, with the lower portion of the vessel shown in cross-section to illustrate the sensor and associated circuit board.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

The preferred embodiment of a drinking vessel 10 according to the present invention includes at least one and preferably several LEDs 12 located on the side of the cup, preferably arranged vertically and circumferentialy about the cup as shown in FIG. 1. In the disclosed embodiment, the cup is a double-walled tumbler having a rim 14 integrally molded or otherwise formed together with an inner side wall 16 and an inner base 18, and also having an integrally formed outer wall 20 and outer base 22, with a gap 24 between the inner and outer walls and bases as illustrated in FIG. 1. The top edge 26 of the outer wall is adhesively bonded or otherwise secured to the lower surface 28 of the rim so as to make gap 24 a sealed chamber for an insert 30 bearing advertising indicia 31, and a force-activated indicator assembly as will be described. The insert may be constructed of coated or uncoated paper, paperboard, plastic or other suitable materials. The tumbler is preferably plastic, but may also be of glass or other suitable materials, with a transparent outer side wall as depicted in FIG. 1 for full exposure of the message-bearing insert located in the tumbler in the gap between its side walls. As an alternative to a message printed on an insert, the tumbler may have a message-bearing outer surface on its outer side wall. As a particular example, the message may be the logo, slogan or other trademark of a particular brand of alcoholic or non-alcoholic beverage, e.g., "Shamrock Ale." Double-walled plastic tumblers having a gap between inner and outer side walls as described above are commercially available from Williamson Industries, Shelbyville, Ind., and various other sources.

Mounted within the tumbler's base portion, which is shown in cross-section in FIG. 1, and more specifically, between the inner and outer bases thereof, is a piezoelectric sensor 32 and a printed circuit board 34 containing a signal generator having an output connected to the peripherally located LED or LEDs 12 by connecting wires 36 which also extend through the gap between the tumbler side walls. The LEDs may be suitably positioned in holes provided in the message-bearing insert for that purpose, and retained in position with an adhesive.

The preferred form of piezoelectric sensor is a piezoelectric disc, approximately 25–30 mm in diameter and approximately 0.5 mm thick, commercially available from a number of manufacturers including Panasonic; Ningbo East Electronics Ltd., Ningbo, China; and Jiangsu Yuanyu Electronics Group Companies, Jiangsu, China, and is preferably adhesively bonded to the inner surface of the outer base of the tumbler as shown in FIG. 1 in order to obtain secure coupling to the outer base and consequently high sensitivity to external mechanical force applied to the tumbler during normal use.

The piezoelectric disc is preferably tested to identify which side is more sensitive to force applied perpendicular to the plane of the disc, and the side more sensitive to applied force is oriented toward the bottom of the tumbler. The piezoelectric disc is connected by a pair of connecting wires (not shown) to circuit board 34, with one wire connected to ground and the ungrounded wire selected and connected such that the initial pulse in a damped sinusoidal pulse burst produced by the piezoelectric disc in response to a force applied to its bottom side is positive. The circuit board also has a pair of 1.5V alkaline manganese dioxide button cell batteries 38 mounted thereon in series so as to provide a 3V DC source. Each battery preferably has a capacity of 20–50 mA-hr, although batteries of 100 mA-hr or more capacity are suitable for some applications such as where space and weight constraints are not a significant factor. A 3V lithium manganese dioxide coin cell with 200 mA-hr capacity may be used in the cup in place of the two button cells described above. The circuit board is preferably secured within the base portion of the tumbler by friction and compression forces provided by a foam spacer 40 and a boss 42 arranged as shown in FIG. 1.

Figure 2:
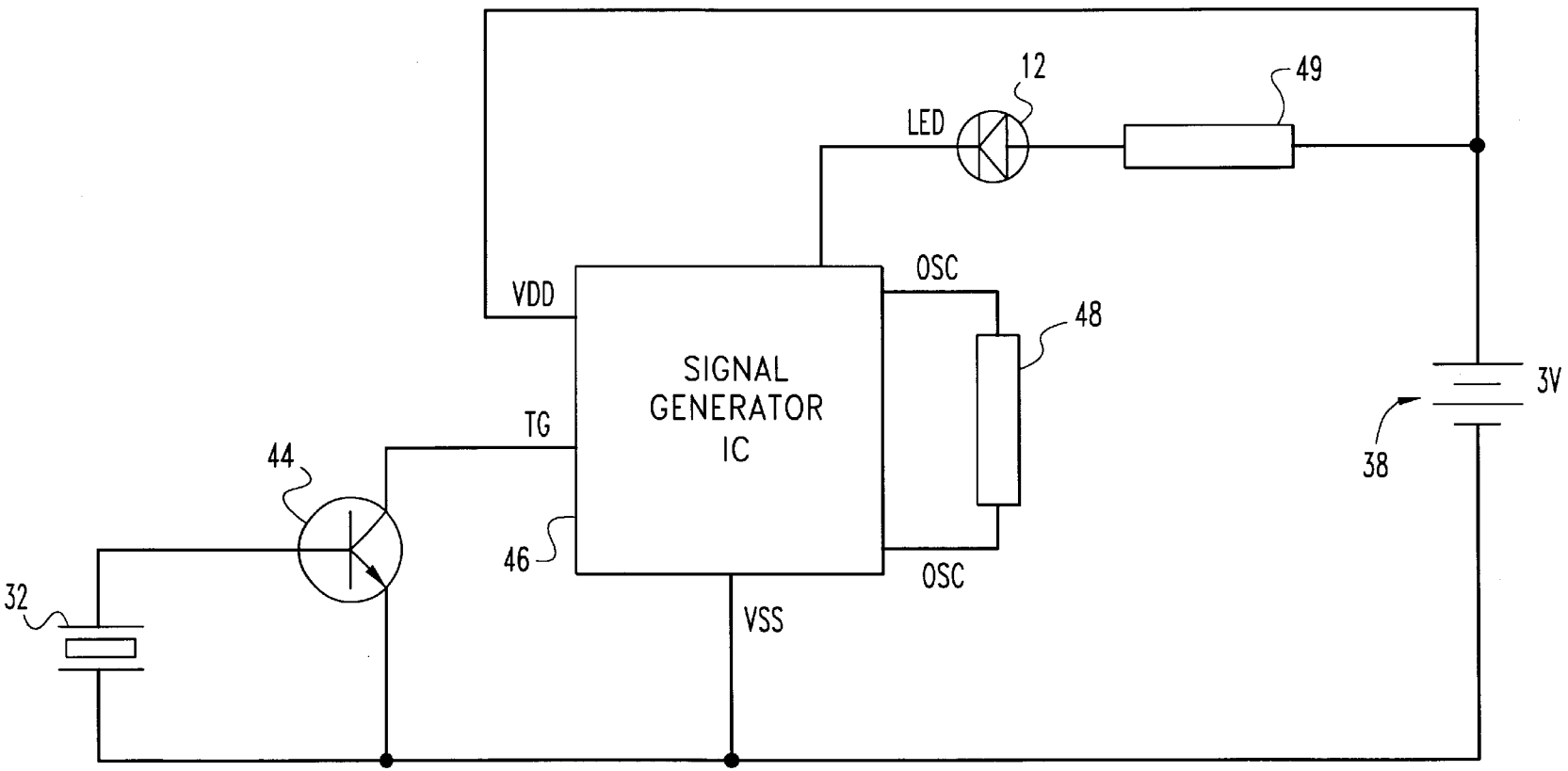
FIG. 2 is schematic of a force-activated indicator circuit according to the preferred embodiment of the present invention.

Referring now to FIG. 2, piezoelectric sensor 32 is coupled to a triggerable signal generator including an NPN transistor 44, which is suitably a type SS9013 available from Samsung, and a signal generator IC 46. With the above-referenced piezoelectric disc and transistor, the circuit is sufficiently sensitive that it responds when the tumbler is set down on a table with the level of force necessary to produce a deceleration of approximately 2 g.

Figure 2A:
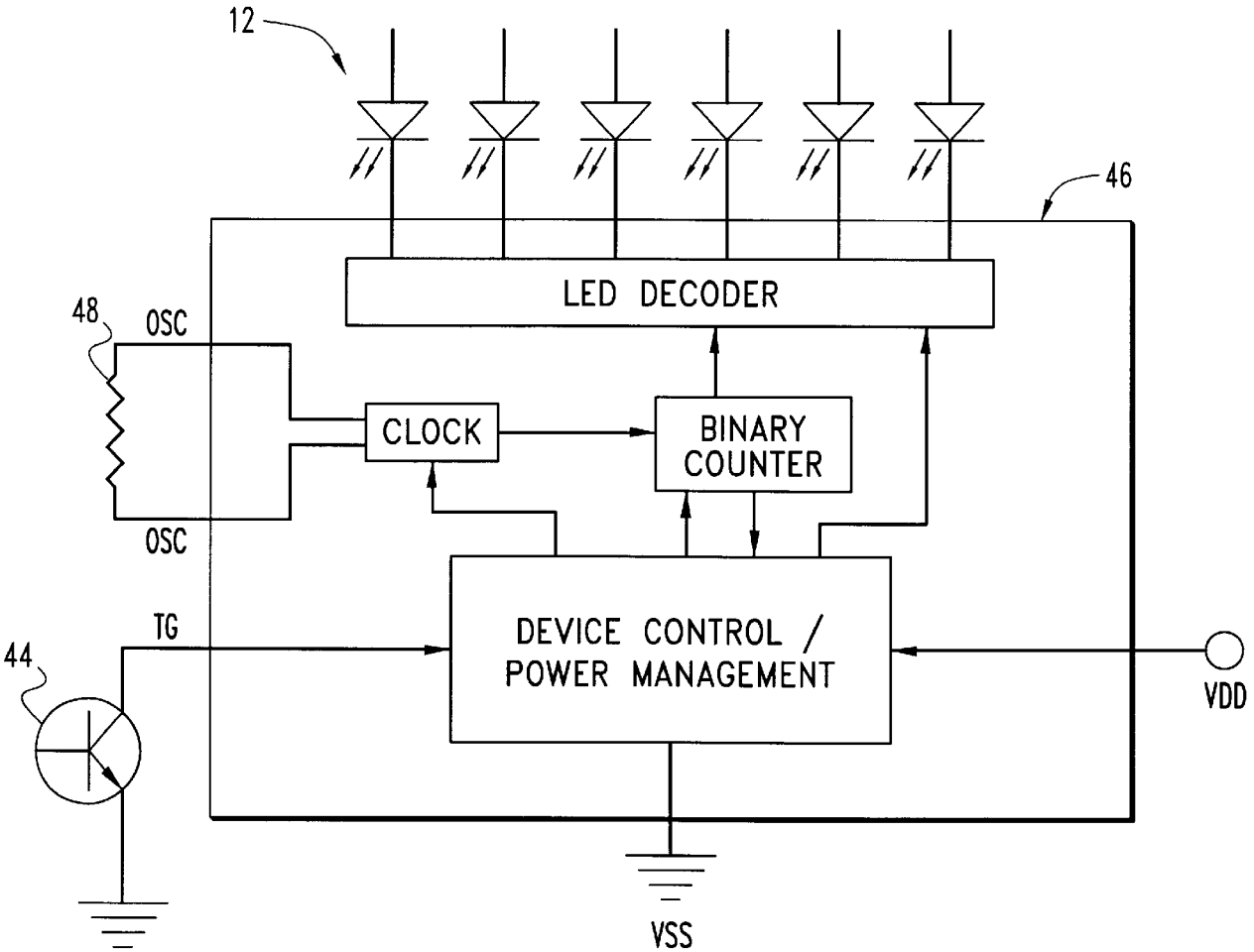
FIG. 2A is block diagram showing further details of the signal generator IC of FIG. 2.

As shown in more detail in FIG. 2A, the signal generator IC suitably contains four main components: a clock, a binary counter, an LED decoder, and a device control and power management circuit interconnected as shown in the drawing. The IC is preferably a monolithic CMOS integrated circuit with an on-chip capacitor in the clock circuit, and an on-chip pull-up resistor in the device control circuit connected to the trigger (TG) input of IC 46, and is fabricated according to well known techniques. The device control circuit provides a battery-saving sleep state for the IC. The device control circuit is continually supplied with power via the VDD input connected to the battery, but it controllably supplies power to the other circuit blocks, which, like the device control circuit, incorporate CMOS technology. Consequently, the device control circuit enables the IC to draw 1 $\mu$A or less of battery current when the IC is in its dormant or sleep state, during which the supply of power to the clock, counter and decoder is switched off by the device control circuit.

The device control circuit is suitably a flip-flop which is set in response to a negative-going pulse, or a low logic level, on the trigger input of the IC, whereupon the device control circuit goes into the active state and supplies battery power to all of the circuit blocks of the IC. The clock then begins oscillation at a frequency determined by the RC time constant of the external resistor 48 and the internal on-chip capacitor. This clock frequency then drives the binary counter which, in turn, drives the LED decoder. The decoder converts binary data from the counter into a sequential firing of the LED outputs at a preset duty cycle. A counter output is also connected back to the device control circuit to reset the device control flip-flop after a predetermined number of cycles, e.g., 32 cycles, of LED activation, and thereby switch the IC back into the sleep state. IC 46 is preferably supplied in die form and wire bonded onto the circuit board.

In the preferred embodiment, with a value of 330 K selected for resistor 48, the LEDs are each on for about 50 milliseconds and off for about 250 milliseconds for 32 cycles, or a total flashing interval of approximately 10 seconds. With the duty cycle and number of cycles internally fixed, the ON and OFF times and total flashing interval are controlled by the single resistor 48, such that proportionately different timing parameters may be obtained if desired by selecting a different value for resistor 48. Importantly, the entire circuit of FIG. 2 draws essentially no current except when the signal generator is triggered and the LEDs are caused to flash. This is because, in the quiescent state, i.e., when there is no force applied to the piezoelectric disc sufficient to generate a trigger pulse, there is no current-drawing component in the circuit other than the device control circuit, which has a quiescent current of 1 $\mu$A or less as described earlier. The LEDs are connected continually to the battery (VDD), and may be provided with corresponding individual series resistors such as resistor 49 of FIG. 1, or with a common resistor connected between VDD and all of the LED anodes. A suitable LED is a high-brightness LED, type HLMPQ105 from Hewlett Packard. With a single LED, a series resistor 49 having a value of 33 Ω has been found suitable; the resulting current when the LED is pulsed ON is approximately 18–°mA.

As an alternative or in addition to LEDs, a speaker may be employed as an indicator supplied with a desired signal from a voice module such as type ISD 1100 available from Information Storage Devices, Inc., San Jose, Calif., with nonvolatile memory sufficient to contain a 10-second message. The sound module may generate a simple tone or melody, or, if desired, may be programmed to reproduce a prerecorded advertising message to complement, or substitute for, the visible advertising indicia on the drinking vessel. The sound module is suitably mounted separately from the the circuit board containing IC46.

In an alternative embodiment, the force-activated indicator is mounted within an insulated holder for a cup or can. Such holders for beverage containers are commercially available in several forms including a cylindrical foam sleeve of solid wall construction, as well as concentric thin plastic sleeves having an insulating air gap therebetween of the type described in connection with the tumbler of FIG. 1. The mounting positions for the sensor, circuit board and LEDs are substantially the same as in the first embodiment described above, and in the case of a foam holder the components are supported directly by the solid foam walls of the holder.

In another alternative embodiment, the force-activated indicator is mounted within a coaster with space provided between the top and bottom surfaces of the coaster for the sensor and circuit board. The sensor is preferably securely coupled to the underside of the top surface of the coaster with the more sensitive side of the piezoelectric disc upwardly oriented. In this embodiment as in the cup holder embodiment described above, the same circuit sensitivity as in the tumbler embodiment has been found suitable. One or more LEDs may be mounted in the top surface of the coaster or around the periphery thereof.

Figure 3:
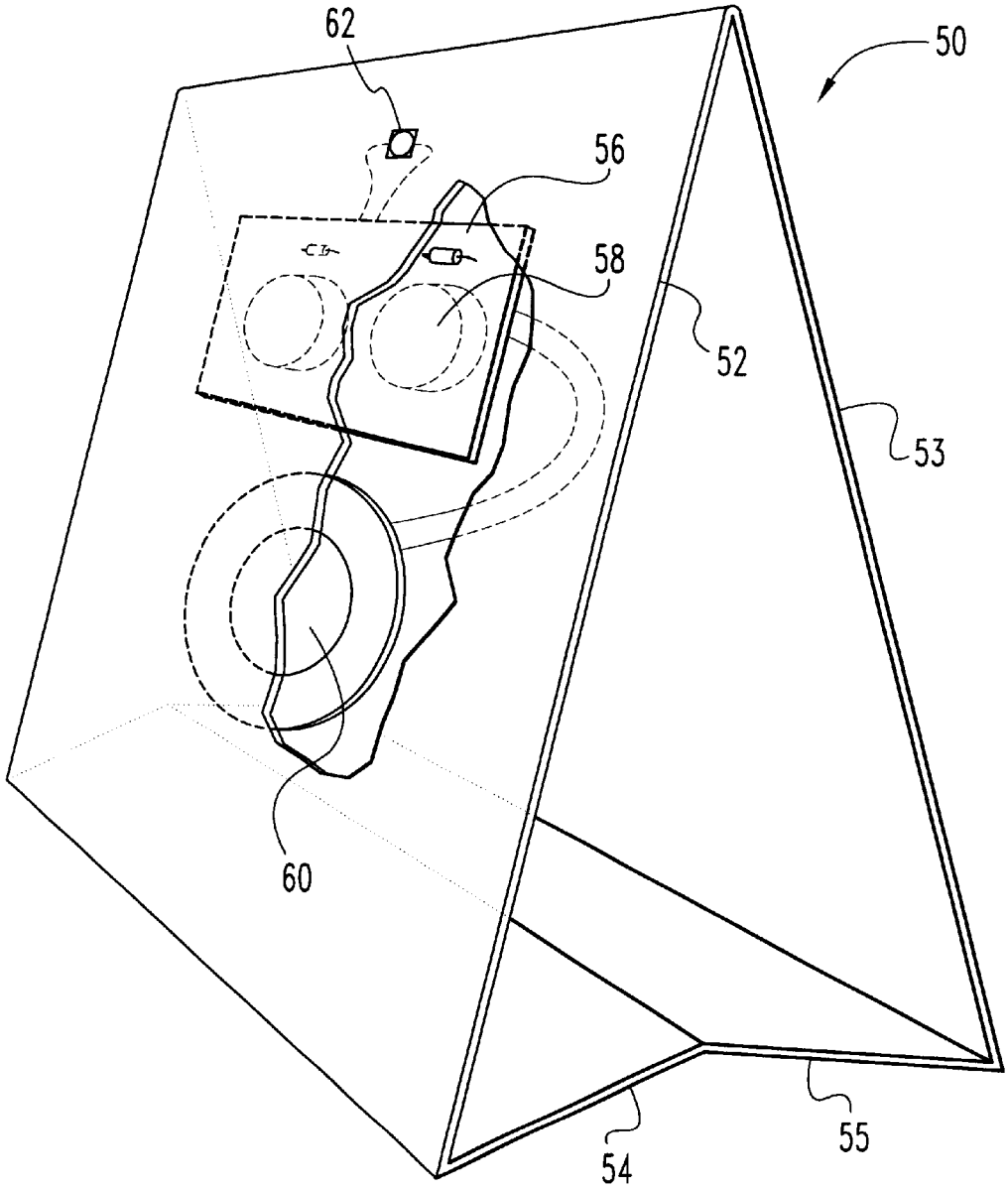
FIG. 3 is a drawing of the preferred embodiment of a tabletop advertising article with force-activated indicator according to the present invention, with a portion broken away to illustrate the sensor and associated circuit board.

Turning now to FIG. 3, a force-activated indicator is provided on a lightweight tabletop advertising article 50, also referred to as a table tent, of the type commonly employed as a promotional device in restaurants, taverns and the like. The table tent has a pair of generally vertically oriented flat panels 52 and 53 attached together at the top in a conventional manner, the panels being constructed of paperboard, thin plastic, coated or uncoated paper or other suitable materials and, depending upon the thickness and rigidity of the panels, supported on their lower ends by a base which may have two foldable portions 54 and 55 as shown in the drawing. Either or both of the panels may bear advertising indicia, such as that shown in FIG. 1, e.g., "Shamrock Ale," and/or other advertising indicia including pictures, designs, logos, and text. Such advertising indicia would preferably occupy the center of the panel, and are not shown in FIG. 3 for purposes of better illustration of the force-activated indicator assembly mounted on the back side of the panel.

A printed circuit board 56 with batteries 58 mounted thereon is secured to the back surface of message-bearing panel 52, and a piezoelectric disc 60 is similarly secured to the back surface of the message-bearing panel, preferably adhesively bonded thereto as described above. The more sensitive side of the piezoelectric disc is oriented toward the front of the panel and the wires from the disc to the circuit are connected such that the initial pulse from the piezoelectric disc in response to a force applied to the front surface of the message-bearing panel is of positive polarity as described above. An LED 62, or multiple LEDs if desired, is mounted in a hole provided in the panel for that purpose, such that it is exposed to view from the front of the panel.

Figure 2B:
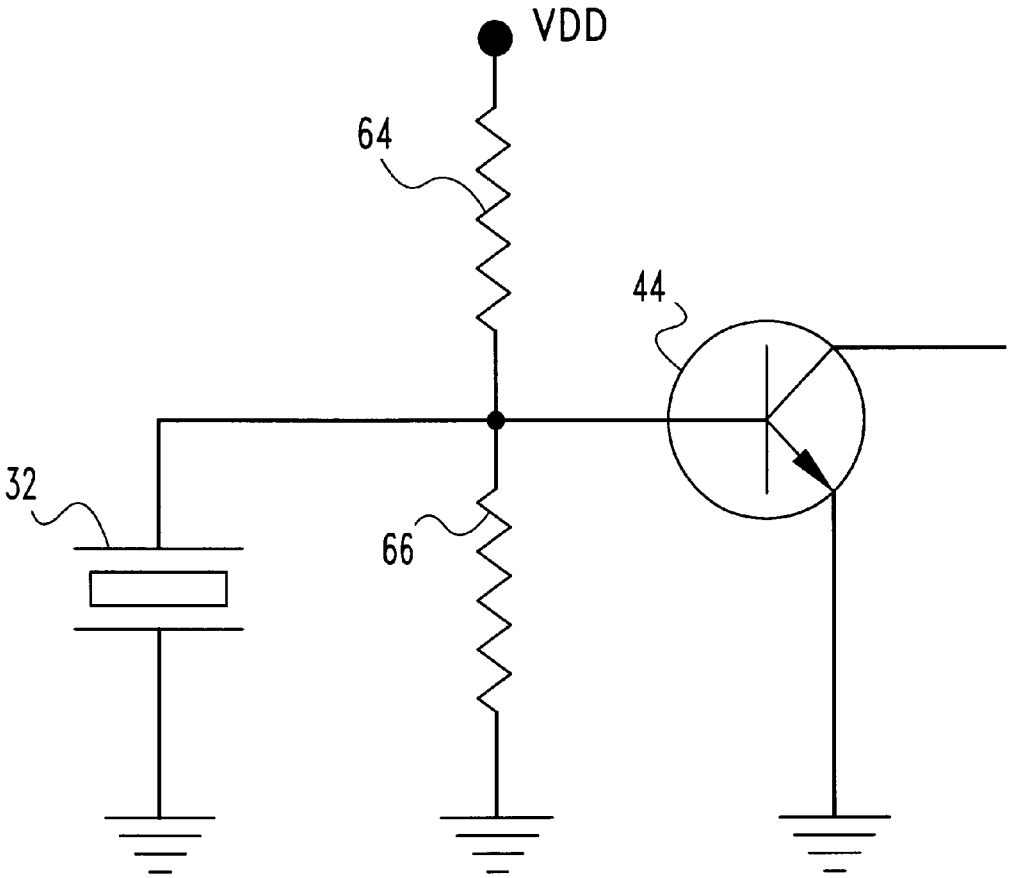
FIG. 2B is a schematic of a portion of an indicator circuit with greater sensitivity than the circuit of FIG. 2.

The indicator circuit is generally the same as that described above with respect to the first embodiment, with the exception that the sensitivity is greater. Increased sensitivity is provided by means of bias resistors 64 and 66 connected to the base of transistor 44 as shown in FIG. 2B. Such bias resistors shift the operating point of the transistor such that conduction can be made to occur in response to a substantially lower force applied to the piezoelectric disc than is possible without the bias resistors. In the table tent embodiment described, greater sensitivity is provided with a value of 10 MΩ for resistor 64 and 1.5 MΩ for resistor 66. In operation, the LED flashes and thereby attracts attention to the advertising message on the panel when the panel is tapped directly by a person at the table or by movement of another object on the table into contact with the table tent. Such actions which produce acceleration amplitudes at the sensor of less than 1 g, and on the order of magnitude of 0.5 g, are sufficient to activate the indicator with the sensitivity set as just described. The circuit has been found to respond when a fork is dropped on the table next to the table tent. Higher or lower sensitivity may be obtained by selecting, for example, higher or lower values, respectively, of resistor 66. As an alternative to bias resistors for variation of the circuit sensitivity, a transistor with a different gain value may be selected for transistor 44.

As an alternative to foldable portions 54 and 55, the base of the table tent may be a single flat plate and the piezoelectric disc may be mounted directly on the base with its more sensitive side downwardly oriented. Space and weight constraints may not be significant factors in some forms of table tents as well as some forms of the embodiment of FIG. 4, to be described, and in those applications AAA batteries may be used in place of button cells or coin cells such as described above.

Figure 4:
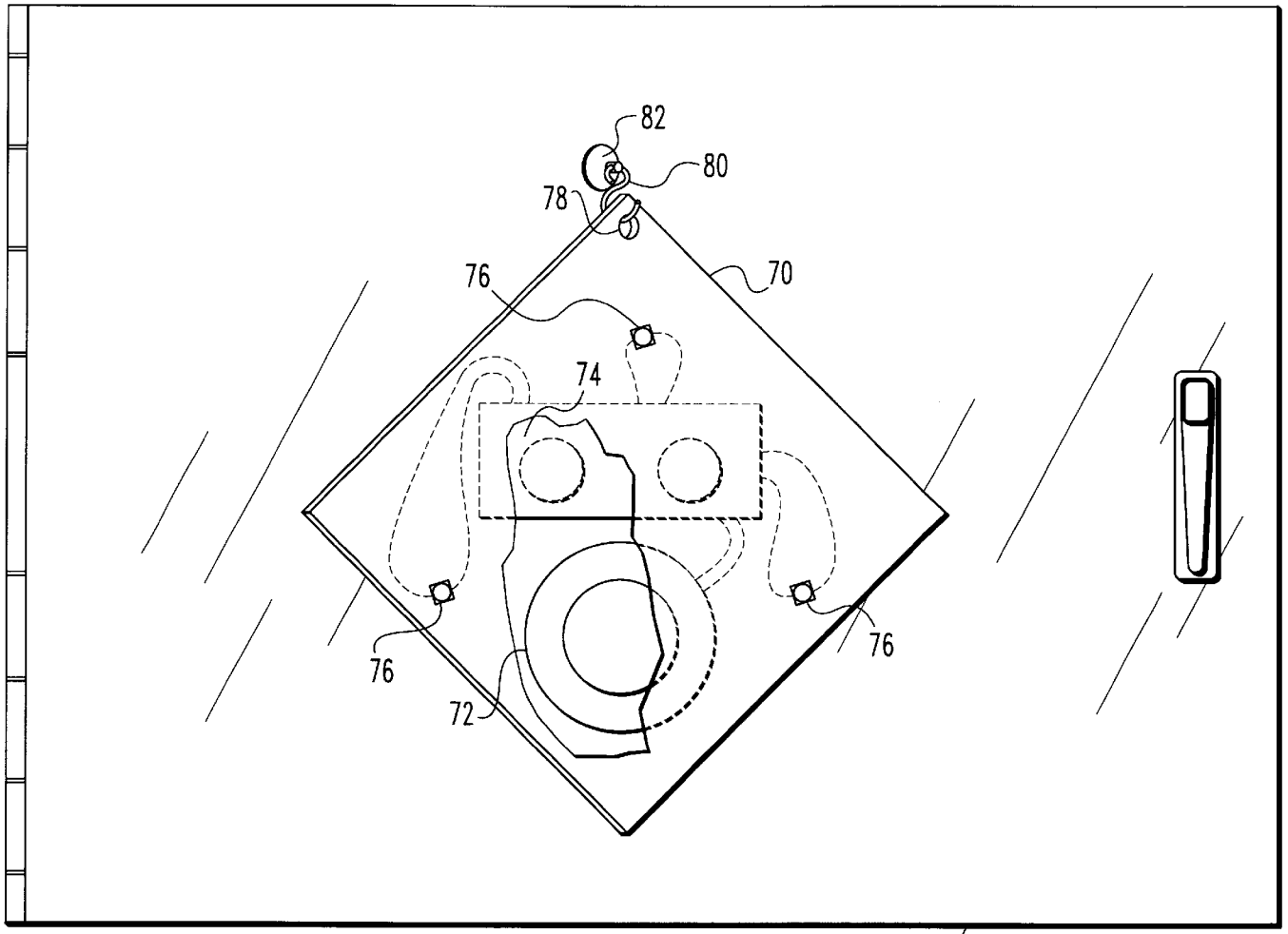
FIG. 4 is a drawing of the preferred embodiment of an advertising ornament with force-activated indicator according to the present invention, with a portion broken away to illustrate the sensor and associated circuit board.

Turning now to FIG. 4, in this embodiment the message-bearing panel 70 may be of the same materials as in the embodiment of FIG. 3 and may be flexible but is preferably flat and sufficiently rigid to transmit forces from any point on its surface to the piezoelectric disc 72, which is preferably secured to the back side of the panel with its more sensitive side in contact with that back side. The front side of the panel bears advertising indicia as described above. Battery-powered printed circuit board 74 is also secured to the back side of the message-bearing panel, and the panel is preferably provided with a plurality of holes for receiving and retaining corresponding LEDs 76 which are controlled by the signal generator in response to the piezoelectric disc as described above.

The message-bearing panel of this embodiment is provided with a mounting hole 78 for attachment of the panel to a hook 80 which is affixed to a suction device 82, or other device such as a magnet, for holding the hook on a movable, vertical support surface, such as that of the door 84 of a refrigerator or cooler. The hook and mounting hole cooperate to maintain spacing between the door of the refrigerator or cooler and the message-bearing panel, and the indicator circuit is preferably provided with bias resistors 64 and 66 of values 10 MΩ and 1.5 mΩ, respectively, as described above, whereby the circuit responds when the panel comes into contact with the door when the door is opened or closed. That is, the advertising ornament responds to force experienced by the door during normal use, and thereby repeatedly draws attention to the advertising message on the panel.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, principles of the invention are also believed to be applicable to advertising signs adapted for ready attachment, e.g., adhesive attachment, to a front surface of a beverage/ice dispenser. The sensitivity may be set such that, for example, a signal generator of the type described above responds to vibrational forces transmitted to the sign through the dispenser when the ice dispenser is activated.

Principles of the invention are also believed to be applicable to advertising ornaments of the type described above which, instead of having the piezoelectric sensor mechanically connected only to a panel of the advertising article itself, have the piezoelectric sensor connected between the advertising panel and a corresponding support surface, such as a refrigerator door.

As another application of the invention, a beer tap of the type having a handle or lever provided with a brand name or other advertising indicia may be fitted with a piezoelectric sensor in a position where it would normally be contacted directly by the hand of an operator during use, or the tap lever may be modified with a retrofit mechanism having a piezoelectric device mounted between two mechanical parts provided in the mechanism to cause the piezoelectric device to flex slightly during normal use of the tap lever.

We claim:

1. A drinking vessel with automatically activated indicator, comprising:

a drinking vessel;

a piezoelectric sensor comprising a piezoelectric wafer mounted in said drinking vessel and responsive to mechanical force applied to said drinking vessel;

a triggerable signal generator having a trigger input connected to said piezoelectric sensor and triggered by a predetermined output signal level produced by said piezoelectrical sensor in response to mechanical force applied to said vessel during normal use; and an indicator connected to said signal generator, wherein said indicator is an audible indicator.

2. A drinking vessel with automatically activated indicator, comprising:

a drinking vanssel;

a piezoelectric sensor mounted in said drinking vessel and responsive to mechanical force applied to said drinking vessel;

a triggerable signal generator having a trigger input connected to said piezoelectric sensor and triggered by a predetermined output signal level produced by said piezoelectrical sensor in response to mechanical force applied to said vessel during normal use; and an indicator connected to said signal generator, wherein said indicator is a visual indicator, and wherein said piezoelectric sensor comprises a piezoelectric wafer.

3. The drinking vessel of claim 2, wherein said drinking vessel includes an elongated sidewall portion of generally circular cross-section and a base integrally joined to said sidewall portion, further comprising a printed circuit board mounted within said base, wherein said signal generator is mounted on said printed circuit board within said base, said piezoelectric sensor is separately mounted within said base, and said visual indicator includes a plurality of LEDs located around and along said sidewall portion of said drinking vessel.

4. The drinking vessel of claim 3, wherein said signal generator includes integrated circuit means for generating a pulse train in response to a trigger signal, and transistor means responsive to said piezoelectric sensor for supplying a trigger signal to said integrated circuit means.

5. The drinking vessel of claim 4, wherein said triggerable signal generator is triggered by an output signal level produced by said piezoelectric sensor in response to a force applied vertically to the bottom of said drinking vessel corresponding to an acceleration amplitude of approximately 2 g.

6. The drinking vessel of claim 5, further comprising a button cell battery mounted on said printed circuit board within said base.

7. The drinking vessel of claim 2, wherein said signal generator is a low-voltage integrated circuit.

8. The drinking vessel of claim 2, wherein said wafer is less than 1 mm thick and has a diameter substantially greater than its thickness.

9. The drinking vessel of claim 8, wherein the diameter of said wafer is on the order of fifty times its thickness.

10. The drinking vessel of claim 2, wherein said drinking vessel includes an elongated sidewall portion having a longitudinal axis, and a hollow base integrally joined to said sidewall portion, and wherein said wafer is mounted within said base with its major surfaces perpendicular to said longitudinal axis.

11. An advertising article with an automatically activated indicator, comprising:

an advertising article;

a piezoelectric sensor connected to said advertising article and responsive to mechanical force applied to said article;

a triggerable signal generator having a trigger input connected to said piezoelectric sensor and triggered by a predetermined output signal level produced by said piezoelectric sensor in response to mechanical force applied to said advertising article during normal use; and an indicator connected to said signal generator;

wherein said signal generator includes integrated circuit means for generating a pulse train in response to a trigger signal, and transistor means responsive to said piezoelectric sensor for supplying a trigger signal to said integrated circuit means; and wherein said integrated circuit means includes means for generating a pulse train of low duty cycle and approximately 3 pulses per second.

* * * * *

UNITED STATES PATENT AND TRADEMARK OFFICE

CERTIFICATE OF CORRECTION

PATENT NO. : 6,591,524 B1
DATED : July 15, 2003
INVENTOR(S) : Edward D. Lewis et al.

It is certified that error appears in the above-identified patent and that said Letters Patent is hereby corrected as shown below:

Column 2,
Line 21, please change "manysyears" to -- many years --.

Column 6,
Line 22, please change "18-º" to -- 18-20 --.

Signed and Sealed this

Fourth Day of November, 2003

JAMES E. ROGAN
*Director of the United States Patent and Trademark Office*